US006544706B1

(12) United States Patent
Takasaki

(10) Patent No.: US 6,544,706 B1
(45) Date of Patent: Apr. 8, 2003

(54) POLYMERIZED TONER AND PRODUCTION PROCESS THEREOF

(75) Inventor: Takahiro Takasaki, Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/600,983

(22) PCT Filed: Feb. 8, 1999

(86) PCT No.: PCT/JP99/00540

§ 371 (c)(1),
(2), (4) Date: Jul. 25, 2000

(87) PCT Pub. No.: WO99/40488

PCT Pub. Date: Aug. 12, 1999

(30) Foreign Application Priority Data

Feb. 6, 1998 (JP) ..... 10-041356

(51) Int. Cl.[7] ..... G03G 9/093

(52) U.S. Cl. ..... 430/110.2; 430/111.4; 430/108.4; 430/108.1; 430/137.11

(58) Field of Search ..... 430/110.2, 137.11, 430/111.4, 108.4, 108.1

(56) References Cited

U.S. PATENT DOCUMENTS

| | | | | | |
|---|---|---|---|---|---|
| 2,297,691 | A | * | 10/1942 | Carlson | 430/97 |
| 4,626,489 | A | | 12/1986 | Hyosu | |
| 5,153,089 | A | | 10/1992 | Ong et al. | |
| 5,958,640 | A | * | 9/1999 | Hasegawa et al. | 430/110.2 |
| 6,132,919 | A | * | 10/2000 | Ogawa et al. | 430/110.2 |
| 2001/0004667 | A1 | * | 6/2001 | Okubu et al. | 430/110.2 |

FOREIGN PATENT DOCUMENTS

| | | | |
|---|---|---|---|
| CA | 2082892 | A * | 5/1993 |
| EP | 0331015 | A * | 9/1989 |
| JP | 56-64349 | | 6/1981 |
| JP | 56-110951 | | 9/1981 |
| JP | 57-45558 | | 3/1982 |
| JP | 59-62870 | | 4/1984 |
| JP | 59-116757 | | 7/1984 |
| JP | 60-173552 | | 9/1985 |
| JP | 61-56356 | | 3/1986 |
| JP | 61-118758 | | 6/1986 |
| JP | 63-276064 | | 11/1988 |
| JP | 2-64557 | | 3/1990 |
| JP | 2-259657 | | 10/1990 |
| JP | 4-50867 | | 2/1992 |
| JP | 4-328581 | | 11/1992 |
| JP | 5-212271 | | 8/1993 |
| JP | 5-313402 | | 11/1993 |
| JP | 6-19182 | | 1/1994 |
| JP | 8-179553 | | 7/1996 |
| JP | 8-234485 | | 9/1996 |
| JP | 8-286416 | | 11/1996 |
| JP | 9-197804 | | 7/1997 |
| JP | 9-230630 | | 9/1997 |

OTHER PUBLICATIONS

English translation of JP 2–64557. (1990).*
JPO Translation of JP 8–179553 (Jul. 1996).*
JPO Translation of JP 5–313402 (Nov.1993).*
JPO Translation of JP 9–197804 (Jul.1997).*
JPO Translation of JP 9–230630 (Sep.1997).*
Derwent Abstract 1998–440202 (1998).*
Derwent Abstract 1981–52541 (1981).*
Derwent Abstract 1990–112694 (1990).*

* cited by examiner

*Primary Examiner*—Christopher Rodee
(74) *Attorney, Agent, or Firm*—Dinsmore & Shohl LLP

(57) ABSTRACT

A polymerized toner of a core-shell structure, comprising colored polymer particles which contain a colorant, and a polymer layer which covers each of the colored polymer particles, wherein the polymerized toner has the following features:

(a) the gel content being 60 to 95% as measured by an extraction method with tetrahydrofuran;

(b) the melt index being 0.5 to 15 g/10 min as measured at 150° C. and under a load of 2.16 kg; and (c) the spheroidicity represented by an average value of a ratio (rl/rs) of a length (rl) to a breadth (rs) being 1.0 to 1.2, and a production process thereof.

21 Claims, No Drawings

POLYMERIZED TONER AND PRODUCTION PROCESS THEREOF

TECHNICAL FIELD

The present invention relates to a polymerized toner and a production process thereof, and more particularly to a polymerized tone of a core-shell structure, which is suitable for use in developing an electrostatic latent image formed by an electrophotographic process, electrostatic recording process or the like, and a production process thereof.

BACKGROUND ART

In an image forming apparatus such as an electrophotographic apparatus or electrostatic recording apparatus, an electrostatic latent image is formed on a photosensitive member has heretofore been developed with a developer. After the developer image formed by the development is transferred to a transfer medium such as paper as needed, the unfixed image is fixed by any of various methods such as heating, pressing and use of solvent vapor. As the developer, a toner is used either singly or in combination with carrier particles and/or a flowability improver. The toner means colored particles obtained by dispersing a colorant such as carbon black and other additives in a binder resin. Processes for producing toner are roughly divided into a grinding process and a suspension polymerization process.

In the grinding process, a thermoplastic resin, a colorant, a charge control agent, a parting agent and the like are melted and mixed into a resin composition, and the resin composition is ground and then classified, thereby producing a toner having a desired particle diameter. According to the grinding process, a toner having a measure of excellent properties can be produced. However, the grinding process involves important problems.

First, in the grinding process, there is a limit to the selection of materials for the toner. The resin composition formed by the melting and mixing must be such that can be ground and classified by economically usable apparatus. This requirement obliges the resin composition to become fully brittle. When the brittle resin composition is ground into particles, the colored particles formed tend to have a wide particle diameter distribution. In order to obtain a copy image having good resolution and gradation by an electrophotographic process, a toner having a narrow particle diameter distribution must be used. In the grinding process, therefore, the ground product must be classified after the grinding step of the resin composition to narrow the particle diameter distribution. Although the particle diameters of particles to be removed by classification vary according to the intended average particle diameter of the resulting toner, fine powder having a particle-diameter of 5 $\mu$m or smaller and coarse powder having a particle diameter of 20 $\mu$m or greater must be removed by classification, for example, when a toner having an average particle diameter of about 10 $\mu$m and a narrow particle diameter distribution is provided. Therefore, such classification results in a reduction in the yield of the toner.

Second, in the grinding process, it is difficult to uniformly disperse solid fine particles such as the colorant, charge control agent and parting agent in the thermoplastic resin. The unevenly dispersed state of the solid fine particles may form the cause that fog is increased, or image density is lowered. The uneven dispersion of these solid fine particles in the grinding process adversely affects the flowability, triboelectrification properties and the like of the resulting toner to a great extent to deteriorate properties of the toner, such as developing characteristics and durability. Accordingly, in the grinding process, it is necessary to take good care to uniformly disperse these solid fine particles. However, the dispersion by the melting and mixing has its limit.

Third, in order to improve the fixing ability of the resulting toner so as to meet high-speed copying and formation of full-color images, it is necessary to lower the glass transition temperature of the toner. When a thermoplastic resin having a low glass transition temperature is used, however, difficulty is encountered on the grinding of the resulting resin composition. Therefore, the glass transition temperature of the toner cannot be lowered to 60° C. or lower. It is hence difficult to provide a toner improved in fixing ability by the grinding process.

In order to overcome these problems in the grinding process, processes of producing a toner by suspension polymerization have been proposed in recent years. In the suspension polymerization process, (1) a monomer composition containing at least a polymerizable monomer and a colorant, with additives such as a charge control agent and a parting agent dissolved or uniformly dispersed therein as needed, is prepared, (2) the monomer composition is then poured into water or an aqueous dispersion medium composed principally of water, which contains a dispersion stabilizer, and the mixture is stirred until the average droplet diameter of droplets becomes constant, (3) a polymerization initiator is added to the dispersion and dispersed therein by means of a mixing device capable of mixing with high shearing force to form the monomer composition into fine droplets, and (4) the droplets are then polymerized to form colored polymer particles (i.e., polymerized toner).

According to the suspension polymerization process, the solid fine particles such as the colorant, charge control agent and parting agent are added to the polymerizable monomer, which is a low-viscosity liquid, to disperse them therein. Therefore, a satisfactory dispersing quality compared with the grinding process, in which such components are dispersed in the thermoplastic resin, can be ensured. According to the suspension polymerization process, a toner having a desired particle diameter and a narrow particle diameter distribution can be generally obtained at a yield as high as at least 90%, and so such a process has an economical advantage over the grinding process. Further, the glass transition temperature of the polymerized toner can be adjusted by selecting the kinds and combination of polymerizable monomers. As described above, the problems involved in the grinding process can be solved by the use of the suspension polymerization process. The polymerized toner can provide good copy images excellent in resolution and gradation and free of fog because it has a sharp particle diameter distribution and good electric properties, and moreover can be produced economically. However, the conventional polymerized toners have not come to fully meet the level of requirements for toners in recent years.

Copying machines, printers and the like of the electrophotographic system have been recently required to reduce demand power and to achieve the speeding-up of copying or printing. A step in which energy is particularly demanded in the electrophotographic system is a fixing step conducted after transferring a toner image from a photosensitive member to a transfer medium such as transfer paper. In the fixing step, the toner is fixed to the transfer medium by heating and melting it. Therefore, a heating roll heated to a temperature of at least 150° C. is used, and electric power is used as an energy source therefor. There is a demand for lowering the temperature of the heating roll from the viewpoint of energy saving. In order to lower the temperature of the heating roll, it is necessary to use a toner capable of fixing at a temperature lower than that heretofore used. Namely, it is necessary to lower the fixing temperature of the toner itself. Besides, the speeding-up of copying and printing has been strongly required with the advancement of the combination of image forming apparatus and the formation of personal computer network. In order to realize high-speed copying machines and high-speed printers, it is necessary to conduct fixing in a shorter time than before. When the fixing temperature of a toner can be lowered, it is also possible to shorten the fixing time by controlling the temperature of a heating roll. Therefore, the lowering of the fixing temperature of the toner also can meet the speeding-up of copying and printing.

In order to meet requirements of energy saving, high-speed copying and the like from an image forming apparatus in the design of a toner, it is only necessary to lower a glass transition temperature of a binder resin (polymer component) making up the toner. When a toner is made up of a binder resin having a low glass transition temperature, however, the toner becomes poor in the so-called shelf stability because particles themselves of the toner tend to undergo blocking during storage or shipment, or in a toner box of an image forming apparatus, to aggregate.

In order to permit formation of bright images in color copying or color printing by the electrophotographic system, the mere melting and softening of toners to fusion-bond the toners to a transfer medium are not enough, but it is necessary to uniformly melt and mix the toners of different colors to mix their colors. More specifically, in the color copying or color printing, development is generally conducted with color toners of 3 or 4 different colors to transfer the resulting toner image to a transfer medium at a time or by 3 or 4 installments, and the toner image is then fixed. Therefore, the thickness of the toner layer to be fixed becomes thicker compared with a black-and-white image. As described above, the respective color toners overlapped are required to be uniformly melted in the fixing of the toners, and so the melt viscosity of each toner at about the fixing temperature thereof must be designed low compared with the conventional toners. Means for lowering the melt viscosity of the toner include, for example, methods in which the molecular weight of a resin used is made lower compared with the resins for the conventional toners, and in which the glass transition temperature thereof is lowered. In any of these methods, however, the toner becomes poor in shelf stability because the toner tends to undergo blocking.

As described above, there is an adverse correlation between the means for coping with the lowering of the fixing temperature of a toner, the speeding-up of printing and the formation of color images, and the shelf stability (blocking resistance) of the toner. As means for solving this adverse correlation, various proposals have heretofore been made. Of these, there has been proposed a toner of a core-shell structure (also referred to as a capsule toner), in which individual colored polymer particles (core) having a low glass transition temperature are coated with a polymer having a high glass transition temperature. However, the conventional means have involved many problems to be solved.

For example, Japanese Patent Application Laid-Open No. 110951/1981 has proposed a toner for development of electrostatic images, comprising particles of a polymer obtained by subjecting a polymerizable composition containing a polymerizable monomer, a crosslinking agent, a reactive prepolymer and a low-molecular weight polyolefin to a polymerization treatment, and a colorant contained in the particles, and a production process thereof. According to this process, however, the offset temperature of the resulting toner becomes low if the proportion of the crosslinking agent is low, so that the offset resistance thereof is deteriorated. If the proportion of the crosslinking agent is high, the fixing temperature of the toner becomes high, so that it is difficult to adjust the balance between the offset resistance and the lowering of fixing temperature, resulting in a failure to provide a toner wide in fixing margin.

Japanese Patent Application Laid-Open No. 45558/1982 has proposed a toner for development of electrostatic images, comprising core particles obtained by polymerization and a coating layer composed of fine particles and formed by emulsion polymerization on each surface of the core particles, and a production process thereof. More specifically, the process comprises mixing and dispersing core particles formed by polymerization in a 1 to 40 wt. % aqueous latex solution, and then adding a water-soluble inorganic salt to the dispersion to form a coating layer composed of fine particles obtained by emulsion polymerization on each surface the core particles. However, the toner obtained by this process has involved a drawback that the environmental dependence of charge properties of the toner becomes great due to the influence of the surfactant and inorganic salt remaining on the fine particles, and in particular, the charge properties are deteriorated under high-temperature and high-humidity conditions.

Japanese Patent Application Laid-Open No. 62870/1984 discloses a process for producing a toner excellent in shelf stability and thermal fixing ability by adopting a polymerization process comprising suspension-polymerizing a toner material containing a monomer, a polymerization initiator and a colorant to form polymer particles and causing a monomer capable of providing a polymer having a glass transition temperature higher than that of the polymer particles to be adsorbed on the polymer particles to grow it. As a method for causing the monomer to be adsorbed on the polymer particles, Examples of this publication disclose a method in which the monomer containing a polymerization initiator is added dropwise to the reaction mixture system containing the polymer particles over a long period of time. However, this method is required to increase the proportion of the monomer added dropwise to the polymer particles to a considerable extent. In the Examples of the publication, the monomer to be added dropwise is actually used in a proportion as high as at least 20 wt. % based on the total weight of the monomer used for forming the polymer particles and the monomer added dropwise. If the proportion of the monomer added dropwise is too high, the shell formed of a layer of the polymer having a higher glass transition temperature becomes too thick, so that the fixing temperature of the resulting toner cannot be fully lowered. Even when low-melting point wax is contained in the polymer particles (core) of the toner of such a structure for improving the fixing ability, only a toner having narrow fixing margin can be provided because a difference between the fixing temperature and the offset temperature lessens.

Japanese Patent Application Laid-Open No. 173552/1985 has proposed a process in which a coating layer composed of a colorant, magnetic particles or a conductive agent and a binder resin is formed on each surface of spherical core particles having a minute particle diameter by means of a jet mill. When core particles having a low glass transition temperature are used in this process, however, the core particles themselves tend to undergo aggregation upon grinding and classification. Accordingly, this process is difficult to provide a toner excellent in low-temperature fixing ability.

Japanese Patent Application Laid-Open No. 56356/1986 discloses a microcapsule type toner comprising a core material and an outer wall for covering the core material, wherein a crosslinked resin is contained in the core material. As a material for the outer wall, there is used a polyurethane resin, polyurea resin, epoxyurea resin, epoxyurethane resin or the like. However, these resins has water absorption property, and so the environmental properties of the resulting toner are deteriorated. In Examples of this publication, the outer wall is formed by an interfacial polymerization process. Since a monomer for formation of the outer wall is used in an amount as much as 42 to 50 wt. %, however, a considerably thick outer wall is formed. If the thickness of the outer wall (shell) is too great, it is difficult to improve the fixing ability of the resulting toner.

Japanese Patent Application Laid-Open No. 259657/1990 has proposed a process for producing a toner for electrophotography, in which crosslinked toner particles prepared by suspension polymerization are added to a solution with an encapsulating polymer, a charge control agent and a parting agent dissolved in an organic solvent, and a poor solvent is then added to the resultant mixture to form a coating layer of the encapsulating polymer containing the charge control agent and the parting agent on each surface of the crosslinked toner particles for the purpose of improving the cleaning ability of the toner. According to this process, the solubility of the encapsulating polymer is reduced by the addition of the poor solvent to deposit a shell layer on each surface of the crosslinked toner particles. Therefore, the layer thickness of the shell formed becomes uneven, and moreover the fixing ability of the resulting toner is deteriorated because the layer thickness of the shell is controlled great for the purpose of retaining the shelf stability.

Japanese Patent Application Laid-Open No. 313402/1993 has proposed a microcapsulated toner used in an image forming method by electronic-beam fixing, not thermal fixing, for the purpose of achieving good low-temperature fixing ability and offset resistance. However, the general-purpose developing devices for electrostatic images adopt the thermal fixing method. The device itself must be changed for converting this method into the electronic-beam fixing method. Therefore, this toner is not practical under the existing circumstances. In Examples of this publication, a monomer composition comprising a monomer component consisting of styrene and methyl methacrylate, a colorant, a charge control agent, and wax is prepared, the monomer composition is then added to distilled water containing a photosensitizer and a dispersing agent to expose the resultant mixture to ultraviolet light, thereby obtaining a core material for toner. After the reaction, the core material for toner is recovered by centrifuging and filtering the reaction mixture, and then dissolved in toluene together with a polymer to become a shell material, thereby obtaining a toner having an average particle diameter of 10 $\mu$m. The fixing temperature of such a toner cannot be lowered even if it is applied to the thermal fixing method.

As described above, it has heretofore been extremely difficult to obtain a toner the fixing temperature of which is lowered without impairing its shelf stability, and which has excellent offset resistance and can meet high-speed copying and formation of full-color images.

DISCLOSURE OF THE INVENTION

It is an object of the present invention to provide a toner for development of electrostatic images, which has a low fixing temperature and a high offset temperature, and at the same time has excellent shelf stability, and a production process thereof.

Another object of the present invention is to provide a toner for development of electrostatic images, which can meet the speeding-up of copying or printing, the formation of full-color images, and the like, can form high-quality images, and further undergoes neither change nor deterioration of image quality even when environmental conditions vary, and a production process thereof.

A further object of the present invention is to provide a toner for development of electrostatic images having such excellent properties as a polymerized toner by a suspension polymerization process.

The present inventors have carried out an extensive investigation with a view toward overcoming the above-described problems involved in the prior art. As a result, it has been found that the above objects can be achieved by forming fine droplets of a monomer composition for core, which contains at least a polymerizable monomer, a colorant and a crosslinkable monomer, in an aqueous dispersion medium containing a dispersion stabilizer, subjecting the monomer composition to suspension polymerization in the presence of a polymerization initiator to form colored polymer particles and then subjecting a polymerizable monomer for shell to suspension polymerization in the presence of the colored polymer particles, thereby producing a polymerized toner of a core-shell structure, and at this time, by devising conditions for the formation of the droplets, a proportion of the crosslinkable monomer used, selection of additive components, etc. to adjust the gel content, melt index and spheroidicity of the polymerized toner within respective selected ranges. The present invention has been led to completion on the basis of this finding.

According to the present invention, there is thus provided a polymerized toner of a core-shell structure, comprising colored polymer particles which contain a colorant, and a polymer layer which covers each of the colored polymer particles, wherein the polymerized toner has the following features:

(a) the gel content being 60 to 95% as measured by an extraction method with tetrahydrofuran;

(b) the melt index being 0.5 to 15 g/10 min as measured at 150° C. and under a load of 2.16 kg; and (c) the spheroidicity represented by an average value of a ratio (rl/rs) of a length (rl) to a breadth (rs) being 1.0 to 1.2.

According to the present invention, there is also provided a process for producing a polymerized toner of a core-shell structure comprising colored polymer particles which contain a colorant, and a polymer layer which covers each of the colored polymer particles, said process comprising the steps of forming fine droplets of a monomer composition for core, which contains at least a polymerizable monomer, a colorant and a crosslinkable monomer, in an aqueous dispersion medium containing a dispersion stabilizer, subjecting the monomer composition to suspension polymerization in the presence of a polymerization initiator to form colored polymer particles and then subjecting a polymerizable monomer for shell to suspension polymerization in the presence of the colored polymer particles to form a polymer layer which cover each of the colored polymer particles, thereby producing polymer particles having a core-shell structure, which have the following features:

(a) the gel content being 60 to 95% as measured by an extraction method with tetrahydrofuran;

(b) the melt index being 0.5 to 15 g/10 min as measured at 150° C. and under a load of 2.16 kg; and (c) the spheroidicity represented by an average value of a ratio (rl/rs) of a length (rl) to a breadth (rs) being 1.0 to 1.2.

BEST MODE FOR CARRYING OUT THE INVENTION

Polymerized Toner of Core-shell Structure

The polymerized toner according to the present invention has a core-shell structure that colored polymer particles containing a colorant are covered with a polymer layer, and the feature thereof resides in that the gel content, melt index and spheroidicity thereof fall within respective selected ranges. The polymerized toner itself of the present invention can be obtained by forming fine droplets of a monomer composition for core, which contains at least a polymerizable monomer, a colorant and a crosslinkable monomer, in an aqueous dispersion medium containing a dispersion stabilizer, subjecting the monomer composition to suspension polymerization in the presence of a polymerization initiator to form colored polymer particles and then subjecting a polymerizable monomer for shell to suspension polymerization in the presence of the colored polymer particles.

1. Gel Content:

The gel content of the polymerized toner according to the present invention is measured as an insoluble matter (%) which is not extracted with a solvent, tetrahydrofuran, when the toner is extracted by means of a Soxhlet extractor by using tetrahydrofuran as an extraction solvent. However, the insoluble matter is calculated out to the exclusion of components originally insoluble in the solvent, such as a pigment. In the polymerized toner according to the present invention, the gel content measured by the extraction method with tetrahydrofuran is 60 to 95 wt. %, preferably 62 to 90 wt. %. If the gel content is too low, the offset temperature of the toner becomes too low, and so the toner tends to cause offset upon fixing. If the gel content is too high on the other hand, the fixing temperature of the toner becomes high. Accordingly, it is necessary to control the gel content within the specified range from the viewpoint of balancing the fixing temperature with the offset temperature in the polymerized toner of the core-shell structure according to the present invention.

2. Melt Index:

The melt index (melt flow rate) as used in the present invention means a flow rate (g) per 10 minutes of a material extracted under conditions of a temperature of 150° C. and a load of 2.16 kg in a flow test for thermoplastic resins by means of an extrusion type melt indexer. The melt index of the polymerized toner according to the present invention is 0.5 to 15 g/10 min, preferably 1 to 12 g/10 min, more preferably 2 to 10 g/10 min.

If the melt index of the polymerized toner is too low, the fixing ability of the toner is deteriorated. If the melt index is too high, the offset temperature of the toner becomes too low, and so the toner tends to cause offset upon fixing.

3. Spheroidicity:

The spheroidicity of the polymerized toner according to the present invention means an average value (the number of particles measured: 100) of a ratio of a length rl to a breadth rs thereof. The spheroidicity must fall within a range of 1.0 to 1.2. In any polymerized toner of a core-shell structure the spheroidicity of which is too great, the thickness of a polymer layer (shell) which covers the surface of each colored polymer particle to become a core becomes uneven, the shelf stability thereof is deteriorated, and moreover such inconveniences as the environmental dependence of images to be formed becomes great, and the durability of image quality is deteriorated are caused. In order to achieve good shelf stability in a state that the spheroidicity is great, it is necessary to make the thickness of the shell great. However, such necessity results in a failure to lower the fixing temperature to improve the fixing ability. When the spheroidicity is controlled within a range of 1.0 to 1.1, the fixing temperature can be fully lowered, and at the same time the offset temperature can be kept high.

Other features of the polymerized toner of the core-shell structure according to the present invention will be described in more detail in the following description as to the raw material and production process of the polymerized toner.

Raw Material of Polymerized Toner

In the polymerized toner of the core-shell structure according to the present invention, a monomer composition containing at least a polymerizable monomer, a colorant and a crosslinkable monomer is used as a raw material. Besides these components, various components, for example, a macromonomer, a charge control agent, a parting agent, molecular weight modifier, a lubricant, a dispersion aid, etc. may be contained in the monomer composition. The typical component of the raw material will hereinafter be described. However, other additives than these components, and the like may be used as optional components as needed.

1. Polymerizable Monomer for Core:

In the present invention, vinyl monomer(s) are generally used as polymerizable monomer(s) for core. Various kinds of vinyl monomers may be used either singly or in any combination thereof, thereby controlling the glass transition temperature (Tg) of the resulting polymer.

Examples of vinyl monomers useful in the practice of the present invention include styrenic monomers such as styrene, vinyltoluene and α-methylstyrene; acrylic acid and methacrylic acid; derivatives of (meth)acrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These vinyl monomers may be used either singly or in any combination thereof.

Among these, combinations of a styrenic monomer with a derivative of (meth)acrylic acid are preferably used as the polymerizable monomer for core. As specific preferable examples thereof, may be mentioned combinations of styrene with butyl acrylate (i.e., n-butyl acrylate), and styrene with 2-ethylhexyl acrylate.

The polymerizable monomer for core used in the present invention is preferably such that can form a polymer having a glass transition temperature of generally 10 to 70° C., preferably 20 to 65° C., more preferably 30 to 60° C. for the purpose of improving the fixing ability of the resulting toner. In the polymerized toner of the core-shell structure, Tg of a polymer component making up colored polymer particles which will serve core particles is made lower than that a polymer component which forms a shell, whereby the fixing temperature of the resulting toner can be lowered, and moreover the shelf stability (blocking resistance) can be enhanced. A difference in Tg between the respective polymer components which form the core and shell is relative.

If Tg of a polymer component making up colored polymer particles which will serve core particles is too high, it is difficult to fully lower the fixing temperature of the resulting polymerized toner, resulting in a failure to satisfactorily meet the speeding-up of copying or printing, the formation of full-color images, and the like. If the Tg is too low, the shelf stability of the resulting polymerized toner becomes liable to be deteriorated even when a shell is formed on each surface of such polymer particles. The Tg is most preferably within a range of 50 to 60° C. If the polymerizable monomer for core is a monomer capable of forming a polymer having a glass transition temperature exceeding 70° C., the resulting polymerized toner comes to have a higher fixing temperature, can not meet the speeding-up of copying or printing and provides images deteriorated in permeability through OHP.

The Tg of the polymer is a calculated value (referred to as calculated Tg) calculated out according to the kind(s) and proportion(s) of monomer(s) used. When the polymerizable monomer used is one, the Tg of a homopolymer formed from this monomer is defined as Tg of the polymer in the present invention. For example, the Tg of polystyrene is 100° C. Therefore, when styrene is used as a monomer by itself, the monomer can be said to form a polymer having a Tg of 100° C. When monomers used are two or more, and the polymer formed is a copolymer, the Tg of the copolymer is calculated out according to the kinds and proportions of the monomers used.

For example, when 80.5 wt. % of styrene and 19.5 wt. % of n-butyl acrylate are used as monomers, the monomer mixture can be said to form a polymer having a Tg of 55° C. because the Tg of a styrene-n-butyl acrylate copolymer formed at this monomer ratio is 55° C. More specifically, the Tg of a polymer can be calculated out in accordance with the following equation:

$$1/Tg=W_1/T_1+W_2/T_2+W_3/T_3+ \quad W_n/T_n$$

wherein

Tg: the glass transition temperature of the (co)polymer (absolute temperature), $W_1, W_2, W_3 \ldots W_n$: % by weight of respective monomers (n means the number of monomers used)

$T_1, T_2, T_3 \ldots T_n$: glass transition temperature (absolute temperature) of a homopolymer formed from each of the monomers (n means the number of monomers used)

2. Crosslinkable Monomer:

A crosslinkable monomer is generally used together with the polymerizable monomer from the viewpoint of improvement in the shelf stability (blocking resistance) of the polymerized toner. As example of the crosslinkable monomer, may be mentioned aromatic divinyl compounds such as divinylbenzene, divinylnaphthalene and derivatives thereof; ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups.

These crosslinkable monomers may be used either singly or in any combination thereof. These crosslinkable monomers are used in a proportion of generally 0.1 to 3 parts by weight, preferably 0.3 to 2 parts by weight per 100 parts by weight of the polymerizable monomer for core. The proportion of the crosslinkable monomer used varies according to the kind of the polymerizable monomer for core used, and the like, and about 0.4 to 0.6 parts by weight per 100 parts by weight of the polymerizable monomer suffice in many cases for achievement of the gel content within the above-described range. If the proportion of the crosslinkable monomer used is too low, any satisfactory gel content cannot be achieved. If the proportion is too high on the other hand, the gel content becomes too high, and hard core particles are formed. In both cases, it is hence difficult to provide a good polymerized toner.

If a high-molecular weight crosslinking agent is used, the necessity of adjusting the melt index with a molecular weight modifier which will be described subsequently is lessened. However, the high-molecular weight crosslinking agent is generally expensive, and has a tendency to make it difficult to finely adjust the gel content within a desired range.

3. Macromonomer:

In the present invention, a macromonomer may be used together with the polymerizable monomer for the purpose of improving a balance among the shelf stability, offset resistance and low-temperature fixing ability of the polymerized toner.

The macromonomer (also referred to as a macromer) is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of generally 1,000 to 30,000. If a macromonomer having a too low number average molecular weight is used, the surface part of the resulting polymerized toner becomes soft, and hence shows a tendency to deteriorate its shelf stability. If a macromonomer having a too high number average molecular weight is used, the melt properties of the macromonomer itself becomes poor, resulting in a polymerized toner deteriorated in fixing ability and shelf stability. Examples of the polymerizable vinyl functional group that the macromonomer has at its molecular chain terminal include an acryloyl group and a methacryloyl group, with the methacryloyl group being preferred from the viewpoint of easy copolymerization.

The macromonomer used in the present invention preferably has a glass transition temperature (Tg) higher than that of a polymer obtained by polymerizing the polymerizable monomer for core. However, a difference in Tg between the polymer obtained by polymerizing the polymerizable monomer for core and the macromonomer may be relative. Tg is a value measured by means of an ordinary measuring device such as a differential scanning calorimeter (DSC). The Tg of the macromonomer used in the present invention is preferably at least 80° C., more preferably 80 to 110° C., particularly preferably 85 to 105° C.

As examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991. Among these macromonomers, hydrophilic macromonomers, in particular, polymers obtained by polymerizing methacrylic esters or acrylic esters either singly or in combination of two or more monomers thereof are particularly preferred.

The proportion of the macromonomer is generally 0.01 to 1 part by weight, preferably 0.03 to 0.8 parts by weight per 100 parts by weight of the polymerizable monomer for core. If the proportion of the macromonomer used is too low, the shelf stability and offset resistance of the resulting toner cannot be sufficiently improved. If the proportion of the macromonomer used is too high, the resulting polymerized toner shows a tendency to deteriorate its fixing ability.

4. Colorant:

In the present invention, a colorant is used for the provision of a polymerized toner. As examples of the colorant, may be mentioned dyes and pigment such as carbon black, Nigrosine Base, aniline blue, Chalcoil Blue, chrome yellow, ultramarine blue, Orient Oil Red, Phthalocyanine Blue and Malachite Green oxalate; and magnetic powders such as cobalt, nickel, diiron trioxide, truiron tetroxide, manganese iron oxide, zinc iron oxide and nickel iron oxide.

Examples of colorants for magnetic color toners include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6.

Examples of pigments include chrome yellow, cadmium yellow, Mineral Fast Yellow, Navel Yellow, Naphthol Yellow S, Hansa Yellow G, Permanent Yellow NCG, Tartrazine Lake, chrome orange, molybdenum orange, Permanent Orange GTR, Pyrazolone Orange, Benzidine Orange, cadmium red, Permanent Red 4R, Watchung Red Ca, eosine lake, Brilliant Carmine 3B, manganese violet, Fast Violet B, Methyl Violet Lake, iron blue, cobalt blue, Alkali Blue Lake, Victoria Blue Lake, Phthalocyanine Blue, Fast Sky Blue, Indanthrene Blue BC, chrome green, chromium oxide, Pigment Green B, Malachite Green Lake and Final Yellow Green G.

Examples of magenta color pigments for full-color toners include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209; C.I. Pigment Violet 19; and C.I. Vat Red 1, 2, 10, 13, 15, 23, 29 and 35.

Examples of magenta dyes include oil-soluble dyes such as C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; and C.I. Disperse Violet 1. Examples of other magenta dyes include basic dyes such as C.I. Basic Red 1, 2, 9, 12, 13, 14, 15, 17, 18, 22, 23, 24, 27, 29, 32, 34, 35, 36, 37, 38, 39 and 40; and C.I. Basic Violet 1, 3, 7, 10, 14, 15, 21, 25, 26, 27 and 28.

Examples of cyan color pigments for full-color toners include C.I. Pigment Blue 2, 3, 15, 16 and 17; C.I. Vat Blue 6; C.I. Acid Blue 45; and copper phthalocyanine pigments with 1 to 5 phthalimidomethyl groups substituted on a phthalocyanine skeleton.

Examples of yellow color pigments for full-color toners include C.I. Pigment Yellow 1, 2, 3, 4, 5, 6, 7, 10, 11, 12, 13, 14, 15, 16, 17, 23, 65, 73, 83, 138 and 180; and C.I. Vat Yellow 1, 3 and 20.

The dyes or pigments are used in a proportion of generally 0.1 to 20 parts by weight, preferably 1 to 10 parts by weight per 100 parts by weight of the polymerizable monomer for core. The magnetic powder is used in a proportion of generally 1 to 100 parts by weight, preferably 5 to 50 parts by weight per 100 parts by weight of the polymerizable monomer for core.

5. Charge Control Agent:

In the present invention, various kinds of charge control agents having positively charging ability or negatively charging ability may be used for the purpose of improving the charging properties of the resulting polymerized toner. Specific examples of the charge control agents include metal complexes of organic compounds having a carboxyl group or a nitrogen-containing group, metallized dyes and nigrosine. More specifically, may be mentioned Nigrosine N-0 (product of Orient Chemical Industries Ltd.), Nigrosine EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-84 (product of Orient Chemical Industries Ltd.), Bontron N-01 (product of Orient Chemical Industries Ltd.), Copy Blue-PR (product of Hoechst AG), and charge control resins such as quaternary ammonium salt-containing resins and sulfonic group-containing resins. The charge control agent is used in a proportion of generally 0.01 to 10 parts by weight, preferably 0.03 to 5 parts by.weight per 100 parts by weight of the polymerizable monomer for core.

6. Parting Agent:

In the present invention, a parting agent may be used for the purpose of improving the parting ability of the resulting polymerized toner. As examples of the parting agent, may be mentioned polyfunctional ester compounds such as pentaerythritol tetrastearate; low molecular weight polyolefins such as low molecular weight polyethylene, low molecular weight polypropylene and low molecular weight polybutylene; paraffin waxes which are waxes-occurred in nature; and synthetic waxes such as Fischer-Tropsch wax.

The polyfunctional ester compounds are preferably polyfunctional ester compounds formed of a trifunctional or still higher polyfunctional polyhydric alcohol and a carboxylic acid. Examples of the trifunctional or still higher polyfunctional polyhydric alcohol include aliphatic alcohols such as glycerol, pentaerythritol and pentaglycerol; alicyclic alcohols such as phloroglucitol, quercitol and inositol; aromatic alcohols such as tris-(hydroxymethyl)benzene; saccharides such as D-erythrose, L-arabinose, D-mannose, D-galactose, D-fructose, L-rhamnose, saccharose, maltose and lactose; and sugar alcohols such as erythoritol, D-threitol, L-arabitol, adonitol and xylitol.

Examples of the carboxylic acid include aliphatic carboxylic acids such as acetic acid, butyric acid, caproic acid, enanthic acid, caprylic acid, pelargonic acid, capric acid, undecanoic acid, lauric acid, myristic acid, stearic acid, margaric acid, arachidic acid, cerotic acid, melissic acid, erucic acid, brassidic acid, sorbic acid, linolic acid, linolenic acid, behenolic acid, tetrolic acid and ximenynic acid; alicyclic carboxylic acids such as cyclohexanecarboxylic acid, hexahydro-isophthalic acid, hexahydroterephthalic acid and 3,4,5,6-tetrahydrophthalic acid; and aromatic carboxylic acids such as benzoic acid, toluic acid, cuminic acid, phthalic acid, isophthalic acid, terephthalic acid, trimesic acid, trimellitic acid and hemimellitic acid. Of these, carboxylic acids having, preferably, 10 to 30 carbon atoms, more preferably, 13 to 25 carbon atoms are preferred, and aliphatic carboxylic acids having the said number of carbon atoms are more preferred. Among the aliphatic carboxylic acids, stearic acid and myristic acid are particularly preferred.

As specific examples of the polyfunctional ester compound, may be mentioned pentaerythritol tetrastearate, pentaerythritol tetramyristate and glycerol triarachidate. It is preferred that the polyfunctional ester compound be easily soluble in the polymerizable monomer for core. Among the polyfunctional ester compounds, pentaerythritol tetrastearate and pentaerythritol tetramyristate are preferred. In the present invention, Fischer-Tropsch wax which is a synthetic wax is particularly preferred. The ordinary waxes are preferably dispersed in the polymerizable monomer by grinding or melting them when mixed with the polymerizable monomer.

In the present invention, the parting agent is used in a proportion of generally 0.1 to 20 parts by weight, preferably 0.5 to 10 parts by weight per 100 parts by weight of the polymerizable monomer for core. The use of the parting agent within the above range permits the improvement of low-temperature fixing ability. If the proportion of the parting agent used is too low, the effect of improving the low-temperature fixing ability becomes little. If the proportion is too high, the shelf stability of the resulting polymerized toner is deteriorated.

7. Molecular Weight Modifier:

In the present invention, a molecular weight modifier may be used for the purpose of, for example, adjusting the melt index of the resulting polymerized toner. Examples of the molecular weight modifier include mercaptans such as t-dodecylmercaptan, n-dodecylmercaptan and n-octylmercaptan; and halogenated hydrocarbons such as carbon tetrachloride and carbon tetrabromide. These molecular weight modifiers are generally contained in the polymerizable monomer for core before the initiation of the polymerization. However, they may be added to the reaction system in the course of the polymerization of the monomer composition for core if desired. The proportion of the molecular weight modifier used is generally 0.01 to 10 parts by weight, preferably 0.1 to 5 parts by weight per 100 parts by weight of the polymerizable monomer for core. The addition of the molecular weight modifier within the above range permits easily adjusting the melt index of the polymerized toner.

8. Lubricant and Dispersion Aid:

In the present invention, any of various kinds of lubricants such as oleic acid, stearic acid, various waxes, and olefinic lubricants such as polyethylene and polypropylene; a dispersion aid such as a silane or titanium coupling agent; and/or the like may be used for the purpose of, for example, improving the uniformly dispersing ability of the colorant in the polymerizable monomer for toner or polymerized toner. Such a lubricant or dispersion aid is generally used in a proportion of about 1/1,000 to 1/1 based on the weight of the colorant.

9. Polymerization Initiator for Core:

In the present invention, fine droplets of a monomer composition for core, which contains at least a polymerizable monomer, a colorant and a crosslinkable monomer, are formed in an aqueous dispersion medium containing a dispersion stabilizer, and the monomer composition is then subjected to suspension polymerization in the presence of a polymerization initiator to prepare colored polymer particles.

As the polymerization initiator for core is generally used a radical polymerization initiator. As examples of the radical polymerization initiator, may be mentioned persulfates such as potassium persulfate and ammonium persulfate; azo compounds such as 4,4-azobis(4-cyanovaleric acid), dimethyl-2,2'-azobis(2-methyl propionate), 2,2-azobis(2-amidinopropane) bihydrochloride, 2,2-azobis-2-methyl-N-1,1-bis(hydroxymethyl)-2-hydroxy-ethylpropionamide, 2,2'-azobis(2,4-dimethylvaleronitrile), 2,2'-azobisisobutyronitrile and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate. Redox initiators composed of combinations of these polymerization initiators with a reducing agent may also be used.

Among these polymerization initiators, oil-soluble radical initiators are preferred, with oil-soluble radical initiators selected from among organic peroxides whose ten-hour half-life temperatures are 60 to 80° C., preferably 65 to 80° C. and whose molecular weights are 250 or lower being particularly preferred. Among the oil-soluble radical initiators, t-butyl peroxy-2-ethylhexanoate is particularly preferred because the resulting polymerized toner scarcely gives odor upon printing and barely causes environmental destruction by volatile components such as odor.

The proportion of the polymerization initiator used is generally 0.01 to 20 parts by weight, preferably 0.1 to 10 parts by weight per 100 parts by weight of the polymerizable monomer for core. Alternatively, the proportion of the polymerization initiator used is generally 0.001 to 5 wt. % based on the aqueous dispersion medium. If the proportion of the polymerization initiator used is too low, the rate of polymerization becomes slow. Any too high proportion is not economical.

The polymerization initiator may be contained in a monomer composition for core in the step of preparing the monomer composition. In order to prevent premature polymerization, however, it is preferable to mix the components other than the polymerization initiator to prepare a monomer composition for core, pour the monomer composition into an aqueous dispersion medium containing a dispersion stabilizer and then add the polymerization initiator while stirring the resultant dispersion. The polymerization initiator poured into the aqueous dispersion medium comes into contact with droplets of the monomer composition for core to migrate into the droplets. High shearing force is then applied to the aqueous dispersion medium to disperse the droplets, thereby forming fine droplets corresponding to the intended particle diameter and particle diameter distribution of the resulting polymerized toner.

10. Dispersion Stabilizer:

A monomer composition for core containing a polymerizable monomer for core, a colorant and a crosslinkable monomer, and optionally various kinds of additives is poured into an aqueous dispersion medium containing a dispersion stabilizer to form fine droplets.

The dispersion stabilizer used in the present invention is preferably colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly water-soluble metal hydroxides are preferred because the drop size and particle diameter distributions of the fine droplets of the monomer composition for core and the resulting colored polymer particles can be narrowed, and the brightness or sharpness of an image formed from such a polymerized toner is enhanced.

These colloids adhere to each surface of the fine droplets of the monomer composition for core and colored polymer particle formed to form a protective layer. Therefore, the use of these colloids is preferred from the viewpoint of stably providing colored polymer particles having the desired particle diameter and particle diameter distribution and properly shaped into sphere.

The colloids of the hardly water-soluble metal hydroxides are not limited by the production process thereof. However, such colloid can be prepared by adjusting the pH of an aqueous solution of a water-soluble polyvalent metallic compound to 7 or higher, thereby obtaining an aqueous dispersion medium containing colloid of a hardly water-soluble metal hydroxide. The adjustment of the pH is generally conducted with an aqueous solution of an alkali metal hydroxide. Accordingly, the colloid of the hardly water-soluble metal hydroxide is preferably colloid of a hardly water-soluble metal hydroxide formed by reacting a water-soluble polyvalent metallic compound with an alkali metal hydroxide in an aqueous phase. Examples of the water-soluble polyvalent metallic compound include the hydrochlorides, carbonates, sulfates, nitrates and acetates of polyvalent metals such as magnesium, calcium, aluminum, iron, copper, manganese, nickel and tin. Examples of the alkali metal hydroxide include sodium hydroxide and potassium hydroxide. Aqueous ammonia may be used in combination for the purpose of adjusting the pH.

The colloid of the hardly water-soluble metallic compound used in the present invention preferably has number particle diameter distributions, $D_{50}$ (50% cumulative value of number particle diameter distribution) of at most 0.5 $\mu$m and $D_{90}$ (90% cumulative value-of number particle diameter distribution) of at most 1 $\mu$m. If the particle diameter of the colloid is too great, the stability of the polymerization reaction system is broken, and the resulting polymerized toner also shows a tendency to deteriorate its shelf stability. The dispersion stabilizer is used in a proportion of generally 0.1 to 20 parts by weight per 100 parts by weight of the polymerizable monomer for core. If the proportion of the dispersion stabilizer used is too low, it is difficult to achieve sufficient polymerization stability, so that polymer aggregates are liable to form. If the proportion of the dispersion stabilizer used is too high on the other hand, the viscosity of the aqueous dispersion medium is increased. It is hence not preferable to use the dispersion stabilizer in such a too low or high proportion.

In the present invention, a dispersion stabilizer containing a water-soluble polymer may be used as needed. As examples of the water-soluble polymer, may be mentioned polyvinyl alcohol, methyl cellulose and gelatin. In the present invention, there is no need to use any surfactant. However, a surfactant may be added for the purpose of stably conducting the polymerization so far as the environmental dependence of the charge properties of the resulting polymerized toner does not become high. The combined use of the above-described colloid with the surfactant makes it easy to form uniform droplets of the monomer composition for core.

11. Polymerizable Monomer for Shell:

The polymerizable monomer for shell used in the present invention is such that can form a polymer having a Tg higher than that of the polymer component forming the core. More specifically, as the polymerizable monomer for shell, monomers capable of forming a polymer having a Tg of 80° C. or higher, such as styrene and methyl methacrylate, are particularly preferably used either singly or in combination of two or more monomers thereof. When the Tg of the polymer component forming the core is far lower than 70° C., the polymerizable monomer for shell may be such that forms a polymer having a Tg of 70° C. or lower. In order to improve the shelf stability of the resulting polymerized toner, the Tg of the polymer formed from the polymerizable monomer for shell is desirably preset within a range of preferably 50 to 120° C., more preferably 60 to 110° C., particularly preferably 80 to 105° C.

If the Tg of the polymer formed from the polymerizable monomer for shell is too low, the shelf stability of the resulting polymerized toner may be lowered in some cases even if such a Tg is higher than that of the polymer component forming the core. A difference in Tg between the polymer component forming the core and the polymer component forming the shell is desirably controlled to preferably at least 10° C., more preferably at least 20° C. As the polymerizable monomer for shell, one or more monomer are used, and a charge control agent may be added to the monomer(s) to use the mixture as a monomer composition. When the charge control agent is added, the charge property of a polymer layer forming the shell is enhanced, and in its turn a polymerized toner of a core-shell structure having excellent charge property can be obtained. As the charge control agent, may be used those mentioned above. The proportion of the charge control agent incorporated is generally 0.01 to 10 parts by weight, preferably 0.03 to 5 parts by weight per 100 parts by weight of the polymerizable monomer for shell. Other additives than the charge control agent may also be added to the polymerizable monomer for shell as needed.

In the polymerized toner of the core-shell structure according to the present invention, the weight ratio of the polymerizable monomer for core to the polymerizable monomer for shell is generally 60/40 to 99.9/0.1, preferably 80/20 to 99.7/0.3, more preferably 90/10 to 99.5/0.5. If the proportion of the polymerizable monomer for shell is too low, the effect of improving the shelf stability becomes little. If the proportion is too high on the other hand, the effect of lowering the fixing temperature becomes little.

12. Polymerization Initiator for Shell:

In the present invention, the polymerizable monomer for shell is added to the reaction system in the presence of the colored polymer particles which will become core particles to conduct polymerization, thereby covering each surface of the core particles (colored polymer particles) with a polymer layer (shell). It is preferable to add a water-soluble radical initiator as a polymerization initiator to the reaction system at the time the polymerizable monomer for shell is added because a polymerized toner of a core-shell structure is easy to form. It is considered that when the water-soluble radical initiator is added, the water-soluble initiator enters in the vicinity of each surface of the core particles to which the polymerizable monomer for shell has migrated, so that a polymer layer is easy to form on the core particle surface.

As examples of the water-soluble radical initiator, may be mentioned persulfates such as potassium persulfate and ammonium persulfate; azo initiators such as 4,4-azo-bis(4-cyanovaleric acid), 2,2-azobis(2-amidinopropane) bihydrochloride and 2,2-azobis-2-methyl-N-1,1-bis-(hydroxymethyl)-2-hydroxyethylpropionamide; and combinations of an oil-soluble initiator such as cumene peroxide with a redox catalyst. The amount of the water-soluble radical initiator used is generally 0.001 to 1 wt. % based on the aqueous medium.

Production Process of Polymerized Toner

The production process of a polymerized toner of a core-shell structure according to the present invention is basically a process comprising forming fine droplets of a monomer composition for core, which contains at least a polymerizable monomer, a colorant and a crosslinkable monomer, in an aqueous dispersion medium containing a dispersion stabilizer, subjecting the monomer composition to suspension polymerization in the presence of a polymerization initiator to form colored polymer particles and then adding a polymerizable monomer for shell to conduct polymerization in the presence of the colored polymer particles.

1. Step of Forming Droplets:

More specifically, a polymerizable monomer, a colorant and a crosslinkable monomer, and optionally, various kinds of additives such as a macromonomer, a dispersion aid, a charge control agent and a molecular weight modifier are mixed to uniformly disperse them by means of a ball mill or the like, thereby preparing an intimate liquid mixture (monomer composition for core). This liquid mixture is then poured into an aqueous medium containing a dispersion stabilizer to disperse it in the aqueous medium by means of a mixer having high shearing force, thereby forming fine droplets. The kind and proportion of the crosslinkable monomer used, and the molecular weight modifier, parting agent and the like are suitably selected, thereby adjusting the gel content and melt index of the resulting polymerized toner so as to fall within the respective desired ranges.

No particular limitation is imposed on the time when the polymerization initiator (generally, an oil-soluble polymerization initiator) is added. However, it is preferably added to the aqueous dispersion medium before the formation of the fine droplets of the monomer composition for core is completed. The time when the polymerization initiator is added varies according to the intended particle diameter of the resulting polymerized toner, but is generally a point of time the volume average droplet diameter of primary droplets formed by the stirring of the monomer composition for core (liquid mixture) after pouring it has amounted to generally 50 to 1,000 $\mu$m, preferably 100 to 500 $\mu$m. If the time period from the pouring of the monomer composition for core into the aqueous dispersion medium to the addition of the radical polymerization initiator is too long, the formation of the fine droplets is completed, so that it may be difficult in some cases to unite the polymerization initiator with the droplets. Therefore, the point of time the radical polymerization initiator is added is generally within 24 hours, preferably 12 hours, more preferably 3 hours after the pouring of the monomer composition for core on a plant-scale, and generally within 5 hours, preferably 3 hours, more preferably 1 hour on a small-scale at a laboratory level though it somewhat varies according to droplet diameter and the scale of reaction. The temperature of the aqueous dispersion medium from the addition of the polymerization initiator to the subsequent droplet-forming step, and further the addition to the polymerization reaction system is desirably regulated within a range of generally 10 to 40° C., preferably 20 to 30° C.

Accordingly, the phrase "after forming fine droplets of a monomer composition for core, the monomer composition is subjected to suspension polymerization in the presence of a polymerization initiator to form colored polymer particles" in the present invention include the mode that the polymerization initiator is united with the droplets of the monomer composition for core in the droplet-forming step to migrate into fine droplets finally formed, and said polymerization initiator is used to conduct suspension polymerization, thereby forming colored polymer particles.

In the droplet-forming step, the above primary droplets are dispersed to secondary droplets having a droplet diameter and a droplet diameter distribution corresponding to the intended particle diameter and particle diameter distribution of the resulting polymerized toner to form fine droplets. The volume average droplet diameter (dv) of the fine particles of the monomer composition is generally about 0.5 to 20 $\mu$m, preferably about 1 to 15 $\mu$m, more preferably about 3 to 10 $\mu$m. If the droplet diameter of the droplets is too great, the particle diameters of the colored polymer particles and polymerized toner become too great, so that the resolution of images formed from such a toner is deteriorated.

The droplet diameter distribution represented by the ratio (dv/dp) of a volume average droplet diameter (dv) to a number average droplet diameter (dp) of the droplets of the monomer composition for core is generally at most 3.0, preferably at most 2.5, more preferably at most 2.0 on a plant-scale though it varies according to production scale. In order to provide a polymerized toner particularly sharp in particle diameter distribution even on the laboratory-scale or plant-scale, the droplet diameter distribution is desirably controlled to preferably at most 1.7, more preferably at most 1.5, particularly preferably at most 1.3. The lower limit of the droplet diameter distribution of the droplets is generally about 1.0. If the droplet diameter distribution of the droplets is too wide, the fixing temperature of the resulting polymerized toner varies, so that inconveniences such as fogging and toner filming tend to occur. The droplets preferably have a droplet diameter distribution that at least 50 vol. %, preferably at least 60 vol. % of the droplets are present within a range of (the volume average droplet diameter ±3 $\mu$m).

In order to form fine particles of the monomer composition for core, a stirrer capable of conducting high-shear stirring such as a TK type homomixer is generally used. Alternatively, a droplet-forming device equipped with a rotor which rotates on its axis at high speed, and a stator surrounding it and having small openings or comb-like teeth is used, and the aqueous dispersion medium containing the monomer composition is passed through between the rotor and the stator, whereby the monomer composition can be formed into droplets having a fine droplet diameter. As examples of such a droplet-forming device, may be mentioned Cleamix manufactured by M Technic K.K. and Ebara Milder-manufactured by Ebara Corporation. The droplet diameter distribution of the droplets is narrowed by stirring the monomer composition for core while applying sufficient high shearing force thereto. The droplet-forming time varies according to production scale. If the shearing time is too short in this droplet-forming step, or the droplet diameter distribution of the droplets is too wide, however, the formation of droplets having a uniform shape becomes insufficient, thereby adversely affecting the spheroidicity of the resulting polymerized toner.

The concentration of the polymerizable monomer for core in the aqueous dispersion medium is generally 5 to 40 wt. %, preferably 8 to 30 wt. %.

2. Step of Preparing Colored Polymer Particles:

In the present invention, colored polymer particles which will become core particles are prepared by forming fine droplets of the monomer composition for core in an aqueous dispersion medium containing a dispersion stabilizer and then subjecting the monomer composition for core to suspension polymerization. In this case, it is preferred from the viewpoint of preventing the formation of scale and coarse particles in a polymerization reactor that the droplet-forming step should be conducted in a separate container, and the suspension containing the droplets obtained in the droplet-forming step be then charged into a polymerization reactor to conduct suspension polymerization. When the droplet-forming step and the suspension-polymerizing step are carried out in the same container, scale is easy to form.

The suspension polymerization is generally carried out by charging the suspension prepared in the droplet-forming step into a reactor equipped with a stirrer while controlling the reaction temperature. The reaction temperature is generally 5 to 120° C., preferably 30 to 120° C., more preferably 35 to 95° C. If the reaction temperature is too low, it is necessary to use a polymerization initiator high in catalytic activity, and so it is difficult to control the polymerization reaction. If the reaction temperature is too high, the additive components in the monomer composition for core, such as a parting agent, tends to migrate into each surface of the resulting colored polymer particles, resulting in a possibility that the particle diameter distribution and spheroidicity of the resulting polymerized toner may be adversely affected.

The suspension polymerization for obtaining the core particles is continued until the conversion of the polymerizable monomer into a polymer reaches generally at least 80%, preferably at least 85%, more preferably at least 90%. If the conversion is too low, a great amount of the polymerizable monomer for core remains unreacted, so that such a monomer is copolymerized with a polymerizable monomer for shell when the polymerizable monomer for shell is added to form a polymer layer, resulting in difficulty in forming any polymer layer (shell) having a sufficiently high Tg. When a difference in Tg between polymers formed from the polymerizable monomer for core and the polymerizable monomer for shell is small, the proportion of the polymerizable monomer for shell used is low, or higher shelf stability is required of the resulting polymerized toner, it is desirable that the suspension polymerization should be continued until the conversion of the polymerizable monomer for core reaches preferably at least 95%, more preferably at least 98%, particularly preferably at least 99%.

The volume average particle diameter (dv) of the colored polymer particles forming core particles is generally 0.5 to 20 $\mu$m, preferably 1 to 15 $\mu$m, more preferably 3 to 10 $\mu$m. The particle diameter distribution (dv/dp) represented by the ratio of a volume average particle diameter (dv) to a number average particle diameter (dp) of the colored polymer particles is generally at most 2.5, preferably at most 2.0, more preferably at most 1.7. In the case where a polymerized toner capable of achieving particularly high image quality is provided, the particle diameter distribution thereof can be reduced to preferably at most 1.5, particularly preferably at most 1.3. The lower limit of the particle diameter distribution is about 1.0. If the particle diameter distribution of the colored polymer particles is too wide, the particle diameter distribution of the resulting polymerized toner of a core-shell structure becomes too wide, resulting in difficulty in achieving high image quality.

3. Step of Forming Shell:

In the present invention, in order to provide the polymerized toner of the core-shell structure, a polymerizable monomer for shell is added to the reaction system in the presence of the colored polymer particles prepared in the above-described step to form a polymer layer, which cover the colored polymer particles, using a polymerization initiator. In this step, it is preferable to add the above-described water-soluble radical initiator as the polymerization initiator for shell.

The polymerizable monomer for shell is preferably added to and polymerized in the reaction system in the form of droplets smaller than the number average particle diameter of the colored polymer particles which will become core particles, since the droplets are easy to migrate into the surfaces of the core particles to form a polymer layer. In order to make the droplet diameter of droplets of the polymerizable monomer for shell small, there may be mentioned, for example, a method in which a finely dispersing treatment is conducted by means of an ultrasonic emulsifier or the like in an aqueous dispersion medium. The use of a monomer having a solubility of at least 0.1 wt. % in water at 20° C. as the polymerizable monomer for shell is preferred because the monomer having a high solubility in water becomes liable to quickly migrate to the surfaces of the core particles to form a polymer layer. On the other hand, when a polymerizable monomer for shell having a solubility lower than 0.1 wt. % in water at 20° C. is used, its migration to the surfaces of the core particles becomes slow. Therefore, it is preferable to polymerize such a monomer after adding it in the form of droplets smaller than the core particles to the reaction system, or add an organic solvent having a solubility of at least 5 wt. % in water at 20° C. to the reaction system, so as to cause the polymerizable monomer for shell to quickly migrate into the surfaces of the core particles.

Examples of the polymerizable monomer for shell having a solubility lower than 0.1 wt. % in water at 20° C. include styrene, butyl acrylate, 2-ethylhexyl acrylate, ethylene and propylene. Examples of the polymerizable monomer for shell having a solubility of at least 0.1 wt. % in water at 20° C. include (meth)acrylic esters such as methyl methacrylate and methyl acrylate; amides such as acrylamide and methacrylamide; vinyl cyanide compounds such as acrylonitrile and methacrylonitrile; nitrogen-containing vinyl compounds such as 4-vinylpyridine; and vinyl acetate and acrolein.

As examples of the organic solvent preferably used in the case where the polymerizable monomer for shell having a solubility lower than 0.1 wt. % in water at 20° C. is used, may be mentioned lower alcohols such as methanol, ethanol, isopropyl alcohol, n-propyl alcohol and butyl alcohol; ketones such as acetone and methyl ethyl ketone; cyclic ethers such as tetrahydrofuran and dioxane; ethers such as dimethyl ether and diethyl ether; and amides such as dimethylformaldehyde. The organic solvent is added in such an amount that the solubility of the polymerizable monomer for shell in the dispersion medium (containing water and the organic solvent in combination) is at least 0.1 wt. %. The amount of the organic solvent used varies according to the kind of the organic solvent, and the kind and amount of the polymerizable monomer for shell. However, it is generally 0.1 to 50 parts by weight, preferably 0.1 to 40 parts by weight, more preferably 0.1 to 30 parts by weight per 100 parts by weight of the aqueous dispersion medium. No particular limitation is imposed on the order of addition of the organic solvent and the polymerizable 52 monomer for shell to the reaction system. In order to facilitate the migration of the polymerizable monomer for shell to the core particles, however, it is preferable to first add the organic solvent to the reaction system and then add the polymerizable monomer for shell.

When a monomer having a solubility lower than 0.1 wt. % in water at 20° C. and a monomer having a solubility of at least 0.1 wt. % in water at 20° C. are used in combination as the polymerizable monomer for shell, it is preferable to first add the monomer having a solubility of at least 0.1 wt. % in water at 20° C. to polymerize it, then add the organic solvent, and further add the monomer having a solubility lower than 0.1 wt. % in water at 20° C. to polymerize it. According to this adding process, the Tg of the polymer component obtained from the polymerizable monomer for shell, which is polymerized in the presence of the core particles, and the amount of the monomer added can be suitably controlled for the purpose of controlling the fixing temperature of the resulting polymerized toner.

In the present invention, a charge control agent can be mixed with the polymerizable monomer for shell, and the mixture can be then added to the reaction system to conduct polymerization, thereby improving the charge properties of the resulting polymerized toner.

As examples of a specific process for polymerizing the polymerizable monomer for shell in the presence of the core particles, may be mentioned a process in which the polymerizable monomer for shell is added to the reaction system of the polymerization reaction which has been conducted for obtaining the core particles, thereby continuously conducting polymerization, and a process in which the core particles obtained in a separate reaction system are charged, to which the polymerizable monomer for shell is added, thereby conducting polymerization stepwise. The polymerizable monomer for shell may be added to the reaction system in one lot, or continuously or intermittently by means of a pump such as a plunger pump.

In this step, it is preferable from the viewpoint of providing a polymerized toner in which an unreacted monomer remains only little that the polymerization reaction is continued until the conversion of the polymerizable monomer in the reaction system reaches generally at least 95%, preferably at least 98%, more preferably at least 99%.

Following the shell-forming step, the polymerized toner of the core-shell structure according to the present invention can be obtained. The average thickness of the shell (polymer layer) is generally 0.001 to 1 $\mu$m, preferably 0.003 to 0.5 $\mu$m, more preferably 0.005 to 0.2 $\mu$m. If the thickness of the shell is too great, the fixing ability of the polymerized toner is deteriorated. If the thickness is too small, the shelf stability of the polymerized toner is deteriorated. The thickness of the shell in the polymerized toner can be determined by directly measuring the shell thickness of each of particles selected at random from electron photomicrographs thereof when they can be observed through an electron microscope. If it is difficult to clearly distinguish the core from the shell by observation through the electron microscope, the average thickness of the shell can be calculated out from the particle diameters of the core particles and the amount of the polymerizable monomer used for forming the shell.

Since the thickness of the shell is extremely small, the volume average particle diameter (dv) of the polymerized toner of the core-shell structure falls within a range of generally 0.5 to 20 $\mu$m, preferably 1 to 15 $\mu$m, more preferably 3 to 10 $\mu$m. The particle diameter distribution (dv/dp) represented by the ratio of a volume average particle diameter (dv) to a number average particle diameter (dp) of the polymerized toner is generally at most 2.5, preferably at most 2.0, more preferably at most 1.7. In the case where a polymerized toner capable of achieving particularly high image quality is provided, the particle diameter distribution thereof can be reduced to preferably at most 1.5, particularly preferably at most 1.3. The lower limit of the particle diameter distribution is about 1.0. If the particle diameter distribution of the polymerized toner is too wide, the resolution and gradation of images formed with such a toner are lowered.

In the production process according to the present invention, the kind and proportion of the crosslinkable monomer used, the kinds and proportions of additives used, such as a molecular modifier and a parting agent, the polymerization process including the droplet-forming step, etc. are controlled, thereby forming polymer particles of a core-shell structure, which have the following features:

(a) the gel content being 60 to 95% as measured by an extraction method with tetrahydrofuran;

(b) the melt index being 0.5 to 15 g/10 min as measured at 150° C. and under a load of 2.16 kg; and (c) the spheroidicity represented by an average value of a ratio (rl/rs) of a length (rl) to a breadth (rs) being 1.0 to 1.2.

Developer

The polymerized toner according to the present invention may be used as a one-component developer as it is or externally adding a flowability-imparting agent thereto. However, the polymerized toner may also be used as a two-component developer by using it in combination with carrier particles if desired.

Examples of the external additives used in the production of the developer comprising the polymerized toner according to the present invention include inorganic particles and organic resin particles. Examples of the inorganic particles include particles of silicon dioxide, aluminum oxide, titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, core-shell type particles in which the core is composed of a methacrylic ester copolymer, and the shell is composed of a styrene polymer, and core-shell type particles in which the core is composed of a styrene polymer, and the shell is composed of a methacrylic ester copolymer. Of these, the particles of the inorganic oxides, particularly, silicon dioxide particles are preferred. The surfaces of these particles can be subjected to a hydrophobicity-imparting treatment, and silicon dioxide particles subjected to the hydrophobicity-imparting treatment are particularly preferred. No particular limitation is imposed on the amount of the external additives used. However, it is generally about 0.1 to 6 parts by weight per 100 parts by weight of the polymerized toner.

Two or more of the external additives may be used in combination. When the external additives are used in combination, it is preferable to use two kinds of inorganic oxide particles or organic resin particles different in average particle diameter from each other in combination. More preferably, it is preferable to use particles (preferably inorganic oxide particles) having an average particle diameter of 5 to 20 nm, preferably 7 to 18 nm and particles (preferably inorganic oxide particles) having an average particle diameter of greater than 20 nm, but not greater than 2 $\mu$m, preferably 30 nm to 1 $\mu$m in combination. The average particle diameter of the external additive particles means an average value of particle diameters of 100 particles selected and measured at random from among particles observed through a transmission electron microscope.

The amounts of the above two kinds of external additives (particles) used are generally 0.1 to 3 parts by weight, preferably 0.2 to 2 parts by weight per 100 parts by weight of the polymerized toner for the particles having an average particle diameter of 5 to 20 nm and generally 0.1 to 3 parts by weight, preferably 0.2 to 2 parts by weight for the particles having an average particle diameter of greater than 20 nm, but not greater than 2 $\mu$m. A weight ratio of the particles having an average particle diameter of 5 to 20 nm to the particles having an average particle diameter of greater than 20 nm, but not greater than 2 $\mu$n is within a range of generally 1:5 to 5:1, preferably 3:10 to 10:3.

The external additives and the polymerized toner are generally charged into a mixer such as a Henschel mixer to mix them under stirring. The external additives attach to the surface of the polymerized toner. The external additives can enhance the flowability of the polymerized toner and also act as an abrasive, and so the formation of a toner film on a photosensitive member can be prevented.

An image forming apparatus, to which the polymerized toner according to the present invention is applied, comprises a photosensitive member, a means for charging the surface of the photosensitive member, a means for forming an electrostatic latent image on the surface of the photosensitive member, a means for receiving a developer, a means for supplying the toner to develop the electrostatic latent image on the surface of the photosensitive member, thereby forming a toner image, and a means for transferring the toner image from the surface of the photosensitive member to a transfer medium.

EXAMPLES

The present invention will hereinafter be described more specifically by the following Examples and Comparative Examples. All designations of "part" or "parts" and "%" as will be used in the following examples mean part or parts by weight and wt. % unless expressly noted.

Physical properties in the following Examples and Comparative Examples were measured in accordance with the following respective methods.

(1) Gel Content:

One gram of a polymerized toner sample was precisely weighed and placed in an extraction thimble (86R, size: 28×100 mm, product of Toyo Filter Paper Co., Ltd.). The extraction thimble was placed in a Soxhlet extractor, and tetrahydrofuran as an extraction solvent was put into a flask placed on the lower part to conduct extraction for 6 hours in accordance with a method known per se in the art. After the extraction, the extraction solvent was recovered, and a soluble component extracted in the extraction solvent was separated by evaporation. The resultant residue was then precisely weighed to calculate out a gel content in the sample in accordance with the following equation:

$$\text{Gel content } (\%)=[(T\times P-S)/(T\times P)]\times 100$$

wherein

T: the amount (g) of the toner sample,

P: the proportion of components other than a pigment in the toner, and

S: the amount (g) of extracted solids.

(2) Melt Index:

A flow rate (g) per unit time was measured at 150° C. under a load of 2.16 kg to convert it to a value per 10 minutes.

(3) Spheroidicity:

An electron microphotograph of a polymerized toner sample was taken, and a ratio (rl/rs) of a length rl to a breadth rs thereof was calculated out about 100 particles per sample to calculate an average value thereof.

(4) Volume Average Particle Diameter and Particle Diameter Distribution:

The volume average particle diameter (dv) and particle diameter distribution, i.e., a ratio (dv/dp) of the volume average particle diameter to a number average particle diameter (dp) of a polymerized toner sample were measured by means of a Multisizer (manufactured by Coulter Co.). The measurement by the Multisizer was conducted under the following conditions:

aperture diameter: 100 μm;

medium: Isothone II (trade name, electrolyte produced by Coulter Co.);

concentration: 10%; and number of particles measured: 50,000 particles.

(5) Thickness of Shell:

Although the thickness of shell can be measured by the Multisizer or through an electron microscope where the thickness of the shell is great, it was calculated out in accordance with the following equation where the thickness of the shell was thin like those in Examples and

COMPARATIVE EXAMPLES $$\pi(r+x)^3/\pi r^3=1+(s/100\rho) \quad \text{(i)}$$

wherein r: the radius (μm) of core particles before addition of a polymerizable monomer for shell (a half of the volume average particle diameter of the core particles found from measurement by the Multisizer);

x: the thickness (μm) of shell;

s: the number of parts of the polymerizable monomer for shell added (per 100 parts by weight of a polymerizable monomer for core); and ρ: the density (g/cm$^3$) of a polymer forming the shell.

The equation (i) is transformed into the equation (ii):

$$(x+r)/r=[1+(s/100\rho)]^{1/3} \quad \text{(ii)}$$

When ρ=1 is substituted into the equation (ii), the equation (iii) is obtained.

$$(x+r)/r=[1+(s/100)]^{1/3} \quad \text{(iii)}$$

From the equation (iii), the equation (iv) is derived.

$$x=r[1+(s/100)]^{1/3}-r \quad \text{(iv)}$$

The thickness of the shell was calculated out using the equation (iv).

(5) Flowability:

Three kinds of sieves (sieve openings: 150, 75 and 45 μm, respectively) are laid on top of another in that order from above, and a developer (4 g) to be measured was precisely weighed and put on the uppermost sieve. The three kinds of.sieves are then vibrated for 15 seconds by means of a powder measuring device ("REOSTAT", trade name; manufactured by Hosokawa Micron Corporation) under conditions of vibration intensity of 4. Thereafter, the weight of the developer captured on each sieve was measured and substituted into its corresponding equation ①, ② or ③ shown below, thereby calculating out the respective numeric values of a, b and c. These values were substituted into the following equation ④ to calculate out a flowability value. The measurement was conducted 3 times on one sample to find an average value thereof.

$a$=[weight (g) of the developer remaining on the sieve of 150 μm]/4 g×100 ①

$b$=[weight (g) of the developer remaining on the sieve of 75 μm]/4 g×100×0.6 ②

$c$=[weight (g) of the developer remaining on the sieve of 45 μm]/4 g×100×0.2 ③

$$\text{Flowability } (\%)=100-(a+b+c) \quad ④$$

(7) Shelf Stability:

Each developer sample was placed in a closed container to seal it, and the container was sunk into a constant-temperature water bath controlled to 55° C. The container was taken out of the constant-temperature water bath after 8 hours had elapsed, and the developer contained in the container was transferred to a 42-mesh sieve. At this time, the developer was quietly taken out of the container so as not to destroy the aggregate structure of the developer in the container, and carefully transferred to the sieve. The sieve was vibrated for 30 seconds by means of the above powder measuring device under conditions of vibration intensity of 4.5. The weight of the developer remaining on the sieve was then measured to regard it as the weight of the developer aggregated. A proportion (wt. %) by weight of the aggregated developer to the weight of the developer first put into the container was calculated out. The measurement was conducted 3 times on one sample to use the average value thereof as an index to the shelf stability.

(8) Fixing Temperature:

A commercially available printer (4 papers per minute printer) of a non-magnetic one-component development system was modified in such a manner that the temperature of a fixing roll can be varied. This modified printer was used to conduct a fixing test. The fixing test was carried out by varying the temperature of the fixing roll in the modified printer to determine the fixing rate at each temperature, thereby finding a relationship between the temperature and the fixing rate.

The fixing rate was calculated from the ratio of image densities before and after a peeling operation using an adhesive tape, which was conducted against a black solid-printed area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate can be calculated out from the following equation:

$$\text{Fixing rate } (\%)=(ID_{after}/ID_{before})\times 100$$

The peeling operation of the adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

In this fixing test, a temperature of the fixing roll at which a fixing rate of the developer amounted to 80% was defined as a fixing temperature of the developer.

(9) Offset Temperature:

Black solid printing was conducted by varying a fixing temperature like the fixing temperature test to determine the offset temperature by whether offset occurred or not at that time. The offset resistance of a test sample is further excellent as a difference between this temperature and the fixing temperature becomes greater.

(10) Environmental Dependence:

The above-described modified printer was used to conduct continuous printing from the beginning under environment of 35° C. in temperature and 80% in relative humidity (H/H) and environment of 10° C. in temperature and 20% in relative humidity (L/L) to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating a developer sample as to the environmental dependence of image quality in accordance with the following standard:

○: the number of the printed sheets that continuously retained the above-described image quality was 10,000 or more;

Δ: the number of the printed sheets that continuously retained the above-described image quality was not less than 5,000, but less than 10,000; and X: the number of the printed sheets that continuously retained the above-described image quality was less than 5,000.

(11) Durability:

Continuous printing was conducted by the above-described modified printer from the beginning under room-temperature environment of 23° C. in temperature and 50% in relative humidity to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating a developer sample as to the durability of image quality in accordance with the following standard:

○: the number of the printed sheets that continuously retained the above-described image quality was 10,000 or more;

66: the number of the printed sheets that continuously retained the above-described image quality was not less than 5,000, but less than 10,000; and X: the number of the printed sheets that continuously retained the above-described image quality was less than 5,000.

Example 1

(1) Preparation of Monomer Composition for Core:

A monomer mixture (calculated Tg of the resulting copolymer=55° C.) composed of 80.5 parts of styrene and 19.5 parts of n-butyl acrylate, 0.3 parts of a polymethacrylic ester macromonomer ("AA6"; Tg=94° C.; product of Toagosei Chemical Industry Co., Ltd.), 0.5 parts of divinylbenzene, 1.2 parts of t-dodecylmercaptan, 7 parts of carbon black ("#25B", trade name; product of Mitsubishi Kagaku Co., Ltd.), 1 part of a charge control agent ("Spiron Black TRH", trade name; product of Hodogaya Chemical Co., Ltd.), and 2 parts of a parting agent (natural gas type Fischer-Tropsch wax, "FT-100", trade name; product of Shell MDS Co.; melting point: 92° C.) were subjected to wet grinding by means of a media type wet grinding machine to obtain a monomer composition (liquid mixture) for core.

(2) Preparation of Aqueous Dispersion Medium Containing Dispersion Stabilizer:

An aqueous solution with 6.2 parts of sodium hydroxide (alkali metal hydroxide) dissolved in 50 parts of ion-exchanged water was gradually added to an aqueous solution with 10.2 parts of magnesium chloride ( water-soluble polyvalent metallic salt) dissolved in 250 parts of ion-exchanged water under stirring to prepare an aqueous dispersion medium containing magnesium hydroxide colloid (colloid of hardly water-soluble metal hydroxide).

The particle diameter distribution of the colloid formed was measured by means of a microtrack particle diameter distribution measuring device (manufactured by Nikkiso Co., Ltd.) and found to be 0.35 $\mu$m in terms of $D_{50}$ (50% cumulative value of number particle diameter distribution) and 0.84 $\mu$m in terms of $D_{90}$ (90% cumulative value of number particle diameter distribution). The measurement by means of the microtrack particle diameter distribution measuring device was performed under the following conditions:

measuring range: 0.12 to 704 μm;

measuring time: 30 seconds; and medium: ion-exchanged water.

(3) Preparation of Polymerizable Monomer for Shell:

Three parts of methyl methacrylate (calculated Tg of the resulting polymer=105° C.) and 100 parts of water were subjected to a finely dispersing treatment by an ultrasonic emulsifier, thereby obtaining an aqueous dispersion of a polymerizable monomer for shell. The droplet diameter of droplets of the polymerizable monomer for shell was found to be 1.6 μm in terms of $D_{90}$ as determined by means of a microtrack particle diameter distribution measuring device by adding the droplets at a concentration of 3% to a 1% aqueous solution of sodium hexametaphosphate.

(4) Droplet-forming Step:

The monomer composition for core obtained in the step (1) was poured into the colloidal dispersion of magnesium hydroxide obtained in the step (2), the mixture was stirred until droplets became stable, and 6 parts of t-butyl peroxy-2-ethylhexanoate ("Perbutyl O", product of Nippon Oil & Fats Co., Ltd.) was added as a polymerization initiator thereto. Thereafter, the resultant dispersion was stirred at 15,000 rpm for 30 minutes under high shearing force by means of a Ebara Milder to form droplets of the monomer composition. The droplet diameter distribution of the droplets was at most 2.0.

At the time a conversion into a polymer reached almost 100% after the aqueous dispersion containing the droplets of the monomer composition was charged into a 10-liter reactor equipped with a agitating blade to initiate a polymerization reaction at 85° C., sampling was conducted to measure the average particle diameter of the resultant core particles. As a result, the volume average particle diameter of the core particles was found to be 7.0 μm.

The reactor was charged with the aqueous dispersion of the polymerizable monomer for shell and a solution with 0.3 parts of 2,2'-azobis[2-methyl-N-(2-hydroxyethyl)-propionamide] ("VA-086", trade name; product of Wako Pure Chemical Industries, Ltd.) as a water-soluble initiator dissolved in 65 parts of distilled water. After the reaction was continued for 8 hours, the reaction was stopped to obtain a reaction mixture having a pH of 9.5. While stirring the reaction mixture, sulfuric acid was added to adjust the pH to about 5.0 to conduct acid washing (at 25° C. for 10 minutes). The thus-treated reaction mixture was then filtered and dehydrated. After the dehydration, washing water was sprayed on the residue to conduct water washing. Thereafter, the thus-treated residue was dried for 2 days by a dryer (at 45° C.) to obtain polymer particles of a core-shell structure.

To 100 parts of the polymer particles obtained above were added 0.8 parts of silica ("R-202", trade name; product of Degussa AG) having an average particle diameter of 14 nm subjected to a hydrophobicity-imparting treatment, and they were mixed by means of a Henschel mixer to prepare a non-magnetic one-component developer.

The polymer particles of the core-shell structure thus obtained had a gel content of 64%, a melt index (MI) of 8.2 g/10 min and a spheroidicity of 1.1. The volume average particle diameter (dv) of the polymer particles was 7.1 μm. The evaluation of image with the developer of the above-described formulation revealed that at both high temperature and high humidity (H/H), and low temperature and low humidity (L/L), extremely good images good in color tone, high in image density and free of fog were obtained. The fixing temperature was as low as 120° C., and the developer had excellent fixing ability. The results of other evaluation are shown in Table 1.

Example 2

An experiment was performed in the same manner as in Example 1 except that the amount of t-dodecylmercaptan was changed from 1.2 parts to 1.0 part. The results are shown in Table 1.

Comparative Example 1

An experiment was performed in the same manner as in Example 1 except that the amounts of divinylbenzene and t-dodecylmercaptan were changed from 0.5 parts and 1.2 parts to 0.35 parts and 1.0 part, respectively. The results are shown in Table 1.

Comparative Example 2

An experiment was performed in the same manner as in Example 2 except that the amount of divinylbenzene was changed from 0.5 parts to 0.7 parts. The results are shown in Table 1.

Comparative Example 3

An experiment was performed in the same manner as in Example 2 except that the amount of divinylbenzene was changed from 0.5 parts to 0.8 parts. The results are shown in Table 1.

TABLE 1

| | Example | | Comparative Example | | |
|---|---|---|---|---|---|
| | 1 | 2 | 1 | 2 | 3 |
| Monomer composition for core (part): | | | | | |
| Styrene | 80.5 | 80.5 | 80.5 | 80.5 | 80.5 |
| n-Butyl acrylate | 19.5 | 19.5 | 19.5 | 19.5 | 19.5 |
| Macromonomer | 0.3 | 0.3 | 0.3 | 0.3 | 0.3 |
| Divinylbenzene | 0.5 | 0.5 | 0.35 | 0.7 | 0.8 |
| t-Dodecylmercaptan | 1.2 | 1.0 | 1.0 | 1.0 | 1.0 |
| Carbon black | 7.0 | 7.0 | 7.0 | 7.0 | 7.0 |
| Parting agent | 2.0 | 2.0 | 2.0 | 2.0 | 2.0 |
| Charge control agent | 1.0 | 1.0 | 1.0 | 1.0 | 1.0 |
| Droplet-forming time (min) | 30 | 30 | 30 | 30 | 30 |
| Monomer for shell (part): | | | | | |
| Methyl methacrylate | 3.0 | 3.0 | 3.0 | 3.0 | 3.0 |
| Polymerized toner: | | | | | |
| Volume average particle diameter (μm) | 7.1 | 7.1 | 7.1 | 7.0 | 7.2 |
| Shell thickness (μm) | 0.035 | 0.035 | 0.035 | 0.035 | 0.035 |
| Gel content (%) | 64 | 86 | 54 | 90 | 98 |
| MI (g/10 min) | 8.2 | 2.0 | 18.0 | 0.3 | 0.1 |
| Spheroidicity | 1.1 | 1.2 | 1.2 | 1.1 | 1.1 |
| Physical properties of developer: | | | | | |
| Fixing temperature (° C.) | 120 | 130 | 110 | 160 | 170 |
| Offset temperature (° C.) | 180 | 190 | 130 | 200 | 220 |
| Glass transition temperature (° C.) | 55 | 56 | 52 | 58 | 59 |
| Shelf stability (%) | 1 | 2 | 36 | 2 | 2 |
| Electrical resistance (log Ω/cm) | 11.3 | 11.2 | 11.1 | 11.3 | 11.2 |
| Image quality: | | | | | |
| (H/H) | ○ | ○ | Δ | Δ | Δ |

TABLE 1-continued

| | Example | | Comparative Example | | |
|---|---|---|---|---|---|
| | 1 | 2 | 1 | 2 | 3 |
| (L/L) | ○ | ○ | Δ | Δ | Δ |
| Durability | ○ | ○ | X | X | X |

(Note)
Carbon black: #25B, trade name, product of Mitsubishi Kagaku Co., Ltd.
Parting agent: natural gas type Fischer-Tropsch wax (FT-100, trade name; product of Shell MDS Co.
Charge control agent: Spiron Black TRH (trade name; product of Hodogaya Chemical Co., Ltd.).

Example 3

An experiment was performed in the same manner as in Example 1 except that 20-minute high-shear stirring was conducted in place of the 30-minute high-shear stirring at 15,000 rpm by means of the Ebara Milder in the droplet-forming step in Example 1. The droplet diameter distribution of droplets in the droplet-forming step was at most 2.0. The results are shown in Table 2.

Comparative Example 4

An experiment was performed in the same manner as in Example 1 except that 10-minute high-shear stirring was conducted in place of the 30-minute high-shear stirring at 15,000 rpm by means of the Ebara Milder in the droplet-forming step in Example 1. The droplet diameter distribution of droplets in the droplet-forming step exceeded 3.0. The results are shown in Table 2.

TABLE 2

| | Example | Comp. Ex. |
|---|---|---|
| | 3 | 1 |
| Monomer composition for core (part): | | |
| Styrene | 80.5 | 80.5 |
| n-Butyl acrylate | 19.5 | 19.5 |
| Macromonomer | 0.3 | 0.3 |
| Divinylbenzene | 0.5 | 0.5 |
| t-Dodecylmercaptan | 1.2 | 1.2 |
| Carbon black | 7.0 | 7.0 |
| Parting agent | 2.0 | 2.0 |
| Charge control agent | 1.0 | 1.0 |
| Droplet-forming time (min) | 20 | 10 |
| Monomer for shell (part): | | |
| Methyl methacrylate | 3.0 | 3.0 |
| Polymerized toner: | | |
| Volume average particle diameter (μm) | 7.2 | 7.1 |
| Shell thickness (μm) | 0.036 | 0.035 |
| Gel content (%) | 72 | 77 |
| MI (g/10 min) | 7.0 | 5.0 |
| Spheroidicity | 1.2 | 1.4 |
| Physical properties of developer: | | |
| Fixing temperature (° C.) | 125 | 130 |
| Offset temperature (° C.) | 180 | 190 |
| Glass transition temperature (° C.) | 56 | 54 |
| Shelf stability (%) | 2 | 22 |
| Electrical resistance (log Ω/cm) | 11.4 | 11.0 |
| Image quality: | | |
| (H/H) | ○ | Δ |
| (L/L) | ○ | Δ |
| Durability | ○ | X |

It is understood from the results shown in Tables 1 and 2 that the gel content, melt index and spheroidicity of a polymerized toner of a core-shell structure are controlled so as to fall within the specific selected ranges, whereby the toner can be provided as a polymerized toner which is excellent in fixing properties, offset resistance and shelf stability and can provide images good in image properties.

INDUSTRIAL APPLICABILITY

According to the present invention, there are provided polymerized toners which are excellent in printing properties, can be fixed at a temperature lower than the conventional fixing temperature, have excellent fixing ability even in high-speed printing or copying, cause no color irregularity even in color printing or copying and can be suitably used in printers and copying machines of an electrophotographic system.

What is claimed is:

1. A polymerized toner of a core-shell structure, comprising colored polymer particles which contain a colorant, and a polymer layer which covers each of the colored polymer particles, wherein the polymerized toner has the following features:

(a) the gel content being 60 to 95% as measured by an extraction method with tetrahydrofuran;

(b) the melt index being 0.5 to 15 g/10 min as measured at 150 ° C. and under a load of 2.16 kg; and (c) the spheroidicity represented by an average value of a ratio (rl/rs) of a length (rl) to a breadth (rs) being 1.0 to 1.2, and wherein the glass transition temperature of a polymer component forming the colored polymer particles is 30 to 60 ° C., and the glass transition temperature of a polymer component forming the polymer layer is 80 to 105° C.

2. The polymerized toner according to claim 1, wherein the volume average particle diameter is 0.5 to 20 μm, and the thickness of the polymer layer is 0.001 to 1 μm.

3. The polymerized toner according to claim 1, wherein the colored polymer particles comprise at least one parting agent selected from the group consisting of polyfunctional ester compounds, natural waxes and synthetic waxes, which each have a melting point of 80 to 110° C., in a proportion of 0.1 to 20 parts by weight per 100 parts by weight of the polymer component forming the colored polymer particles.

4. The polymerized toner according to claim 3, wherein the synthetic wax is Fischer-Tropsch wax.

5. The polymerized toner according to claim 1, wherein the colored polymer particles further contain a charge control resin which is selected from the group consisting of quaternary ammonium salt-containing resins and sulfonic group-containing resins.

6. The polymerized toner according to claim 1, wherein the colored polymer particles further contain a parting agent selected from the group consisting of polyfunctional ester compounds and Fischer-Tropsch wax.

7. The polymerized toner according to claim 6, wherein the parting agent has a melting point of 80 to 110° C., and the colored polymer particles comprise the parting agent in a proportion of 0.1 to 20 parts by weight per 100 parts by weight of polymer component forming the colored polymer particles.

8. The polymerized toner according to claim 1, wherein the colorant is selected from the group consisting of magenta color pigments for full-color toners, cyan color pigments for full-color toners, and yellow color pigments for full-color toners.

9. The polymerized toner according to claim 8, wherein the magenta color pigment is selected form the group consisting of C.I. pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209; C.I. pigment Violet 19; and C.I. Vat Red 1, 2, 10, 13, 15, 23, 29 and 35.

10. The polymerized toner according to claim 8, wherein the cyan color pigment is selected form the group consisting of C.I. pigment Blue 2, 3, 15, 16 and 17; C.I. Vat Blue 6; C.I. Acid Blue 45; and copper phthalocyanine pigments with 1 to 5 phthalimidomethyl groups substituted on a phthalocyanine skeleton.

11. The polymerized toner according to claim 8, wherein the yellow color pigment is selected form the group consisting of C.I. pigment Yellow 1, 2, 3, 4, 5, 6, 7, 10, 11, 12, 13, 14, 15, 16, 17, 23, 65, 73, 83, 138 and 180; and C.I. Vat Yellow 1, 3 and 20.

12. A process for producing a polymerized toner of a core-shell structure comprising colored polymer particles which contain a colorant, and a polymer layer which covers each of the colored polymer particles, said process comprising the steps of forming fine droplets of a monomer composition for core, which contains at least a polymerizable monomer, a colorant and a crosslinkable monomer, in an aqueous dispersion medium containing a dispersion stabilizer, subjecting the monomer composition to suspension polymerization in the presence of a polymerization initiator to form colored polymer particles and then subjecting a polymerizable monomer for shell to suspension polymerization in the presence of the colored polymer particles to form a polymer layer which cover each of the colored polymer particles, thereby producing polymer particles having a core-shell structure, which have the following features:

(a) the gel content being 60 to 95% as measured by an extraction method with tetrahydrofuran;

(b) the melt index being 0.5 to 15 g/10 min as measured at 150° C. and under a load of 2.16 kg; and (c) the spheroidicity represented by an average value of a ratio (rl/rs) of a length (rl) to a breadth (rs) being 1.0 to 1.2.

13. The production process according to claim 12, wherein the weight ratio of the polymerizable monomer contained in the monomer composition for core to the polymerizable monomer for shell is 80/20 to 99.7/0.3.

14. The production process according to claim 12, which forms polymer particles of a core-shell structure, wherein the volume average particle diameter is 0.5 to 20 $\mu$m, and the thickness of the polymer layer is 0.001 to 1 $\mu$m.

15. The production process according to claim 12, wherein the polymerizable monomer contained in the monomer composition for core is capable of forming a polymer having a glass transition temperature of 30 to 60° C., and the polymerizable monomer for shell is capable of forming a polymer having a glass transition temperature of 80 to 105° C.

16. The production process according to claim 12, wherein the monomer composition for core comprises at least one parting agent selected from the group consisting of polyfunctional ester compounds, natural waxes and synthetic waxes, which each have a melting point of 80 to 110° C., in a proportion of 0.1 to 20 parts by weight per 100 parts by weight of the polymerizable monomer.

17. The production process according to claim 16, wherein the synthetic wax is Fischer-Tropsch wax.

18. The production process according to claim 12, wherein the monomer composition for core comprises a macromonomer having a glass transition temperature of at least 80° C. in a proportion of 0.01 to 1 part by weight per 100 parts by weight of the polymerizable monomer.

19. The production process according to claim 12, wherein the monomer composition for core comprises the crosslinking monomer in a proportion of 0.3 to 2 parts by weight per 100 parts by weight of the polymerizable monomer.

20. The production process according to claim 12, wherein the monomer composition for core comprises a molecular weight modifier in a proportion of 0.01 to 10 part by weight per 100 parts by weight of the polymerizable monomer.

21. The production process according to claim 12, wherein in the step of forming the fine droplets of the monomer composition for core, high shearing force is applied to the monomer composition for core in the aqueous dispersion medium containing the dispersion stabilizer to form the monomer composition into fine droplets whose volume average droplet diameter (dv) is 0.5 to 20 $\mu$m and whose droplet diameter distribution represented by the ratio (dv/dp) of a volume average droplet diameter (dv) to a number average droplet diameter (dp) thereof is at most 3.0.

* * * * *